US008870598B2

(12) United States Patent
Qi et al.

(10) Patent No.: US 8,870,598 B2
(45) Date of Patent: Oct. 28, 2014

(54) ACTIVE ELECTRICAL COMMUNICATION CABLE ASSEMBLY

(71) Applicants: Qi Qi, San Jose, CA (US); Jamyuen Ko, Santa Clara, CA (US)

(72) Inventors: Qi Qi, San Jose, CA (US); Jamyuen Ko, Santa Clara, CA (US)

(73) Assignee: Intel Corporation, Santa Clara, CA (US)

( * ) Notice: Subject to any disclaimer, the term of this patent is extended or adjusted under 35 U.S.C. 154(b) by 144 days.

(21) Appl. No.: 13/691,479

(22) Filed: Nov. 30, 2012

(65) Prior Publication Data

US 2014/0154921 A1 Jun. 5, 2014

(51) Int. Cl.
*H01R 13/66* (2006.01)
*H01R 24/50* (2011.01)

(52) U.S. Cl.
CPC ..... *H01R 24/50* (2013.01)
USPC ..... 439/620.03

(58) Field of Classification Search
USPC ..... 439/620.03, 455, 502, 701, 607.01, 439/607.45, 607.58, 76.1; 385/88, 89; 361/748, 679.01
See application file for complete search history.

(56) References Cited

U.S. PATENT DOCUMENTS

| | | | | |
|---|---|---|---|---|
| 5,609,499 | A * | 3/1997 | Tan et al. | 439/445 |
| 5,797,771 | A * | 8/1998 | Garside | 439/607.46 |
| 6,152,754 | A * | 11/2000 | Gerhardt et al. | 439/325 |
| 7,534,141 | B1 * | 5/2009 | Wu | 439/607.01 |
| 8,174,847 | B2 * | 5/2012 | Ohtsuji et al. | 361/818 |
| 2003/0139095 | A1 * | 7/2003 | Yang Lee | 439/607 |
| 2004/0047570 | A1 | 3/2004 | Lo et al. | |
| 2006/0035531 | A1 | 2/2006 | Ngo | |
| 2008/0025676 | A1 | 1/2008 | Wang | |
| 2008/0044141 | A1 | 2/2008 | Willis et al. | |
| 2008/0121171 | A1 | 5/2008 | Hulsey | |
| 2014/0073185 | A1 * | 3/2014 | Siahaan et al. | 439/607.58 |

OTHER PUBLICATIONS

"PCT International Search Report and Written Opinion of the International Searching Authority for International Application No. PCT/US2013045021", (Nov. 19, 2013), Whole Document.

* cited by examiner

*Primary Examiner* — Vanessa Girardi
(74) *Attorney, Agent, or Firm* — Blakely, Sokoloff, Taylor & Zafman LLP

(57) ABSTRACT

An active electric cable assembly suitable for high speed communication (e.g., 10 Gbit/sec) between electronic devices, such as but not limited to a peripheral device (e.g., storage device, docking station, etc.) and a computing platform expansion bus. (e.g., supporting the standards and specifications associated with the trade name Thunderbolt®). In embodiments, through holes, embossments, mechanical stops, micro-coaxial single wires, thermal pads, and dielectric film sheets are utilized in a robust cable assembly.

20 Claims, 7 Drawing Sheets

ACTIVE ELECTRICAL COMMUNICATION CABLE ASSEMBLY

TECHNICAL FIELD

Embodiments of the invention generally relate to electrical communication cable assemblies, and more particularly pertain to active communication cable assemblies that include at least one integrated circuit (IC).

BACKGROUND

Electrical cables that are utilized for transmission of data are becoming more complex as the demands for transmission bandwidth increase. Passive twisted pair cables are now becoming bottlenecks in networks that rely on such cables to link two computing platforms. Communication cables, twisted pair, or otherwise, may further include one or more IC embedded therein to improve transmission bandwidth. Such cabling is typically referred to as "active."

Active electrical cables offering greater bandwidth than passive twisted pair cables may suffer from a high cost of manufacture and/or poor reliability stemming from the greater number of components within a the cable assembly. In addition to offering desired transmission line characteristics, EM shielding, and signal processing capabilities, the many components must also be mechanically secured to withstand tensile, compressive, and torsional forces typically found in the field. For example, multiple cable components may need to be welded or glued together, which is time consuming and may not be able to withstand rigorous environmental tests (e.g., 85° C./85 relative humidity, etc.). Furthermore, many processes that have long been employed in cable assembly may be detrimental to the components of an active cable (e.g., an IC, printed circuit board, etc.). For example, thermal stresses associated with the high temperature of an overmolding process may make such processes and resulting structures unsuitable for an active cable assembly. For at least these reasons, final consumer cost of a high bandwidth cable can be significant.

BRIEF DESCRIPTION OF THE DRAWINGS

Embodiments of the present invention are illustrated by way of example, and not limitation, in the figures of the accompanying drawings in which.

DETAILED DESCRIPTION

In the following description, numerous details are set forth. It will be apparent, however, to one skilled in the art, that the present invention may be practiced without these specific details. In some instances, well-known methods and devices are shown in block diagram form, rather than in detail, to avoid obscuring the present invention. Reference throughout this specification to "an embodiment" or "in one embodiment" means that a particular feature, structure, function, or characteristic described in connection with the embodiment is included in at least one embodiment of the invention. Thus, the appearances of the phrase "in an embodiment" in various places throughout this specification are not necessarily referring to the same embodiment of the invention. Furthermore, the particular features, structures, functions, or characteristics may be combined in any suitable manner in one or more embodiments. For example, a first embodiment may be combined with a second embodiment anywhere the two embodiments are not structurally or functionally exclusive of the other.

The terms "coupled" and "connected," along with their derivatives, may be used herein to describe structural relationships between components. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, and/or that the two or more elements co-operate or interact with each other (e.g., as in a cause an effect relationship).

Described herein are embodiments of an active electric cable assembly suitable for high speed communication between electronic devices, such as but not limited to a peripheral device (e.g., storage, docking station, etc.) and a computing platform expansion bus. One, some, or all of the features of the active electrical cable assembly embodiments described herein may be provided in one or more version of a high speed communication cable that supports the standards and specifications associated with the trade name Thunderbolt®. For example, an active electrical cable assembly in accordance with embodiment of the present invention may be connected to a Thunderbolt® port of a computing platform, accommodating the pin assignments (e.g., 20 pins), data rates (e.g., 10 Gbit/s per device), and all other specifications associated with one or more of the technical standards associated with products marketed under the Thunderbolt® trade name.

Figure 1:
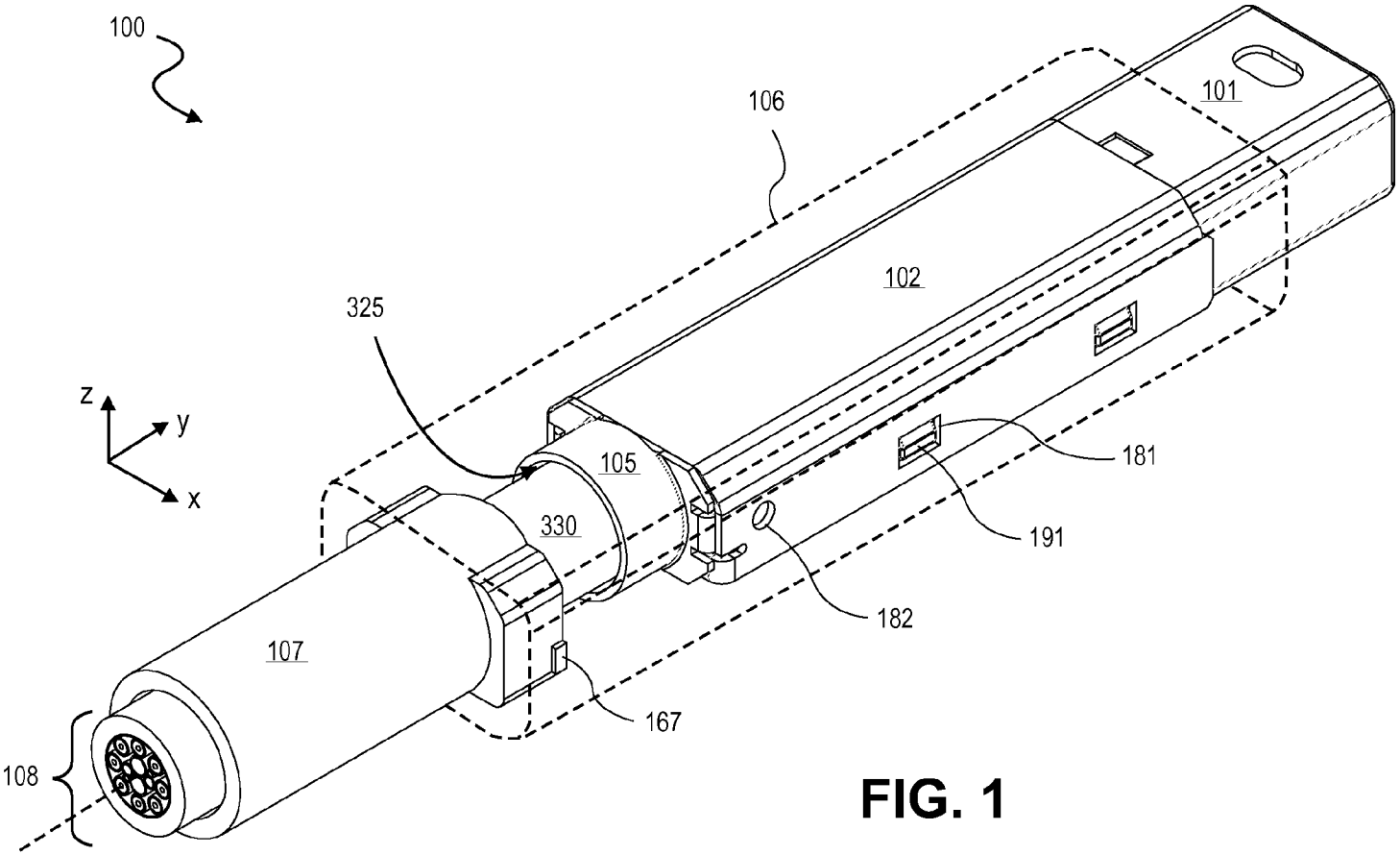
FIG. 1 is an isometric illustration of an active electrical cable assembly, in accordance with an embodiment.
Figure 2:
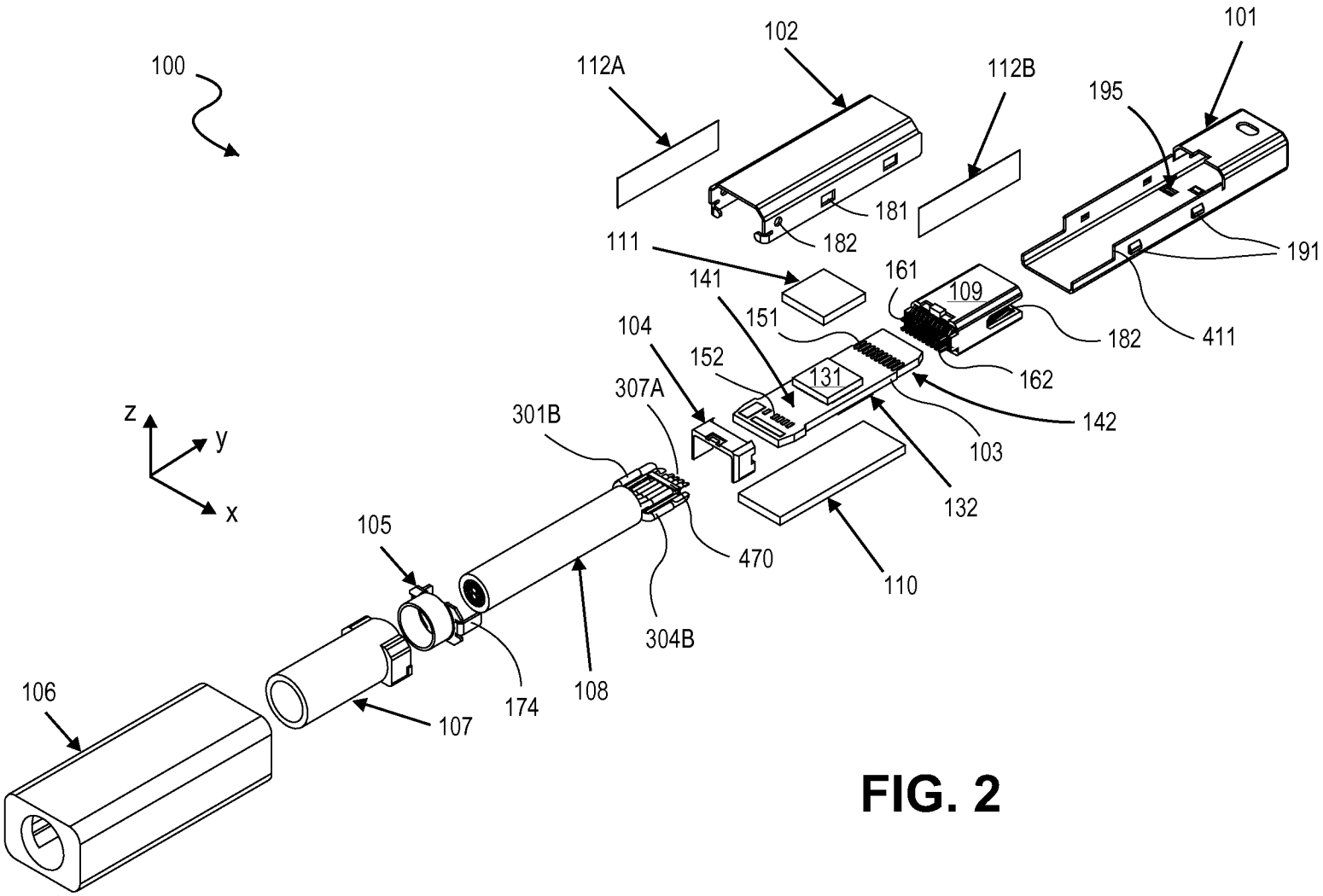
FIG. 2 is an isometric exploded view of the active electric cable assembly of FIG. 1, in accordance with an embodiment.
Figure 3:
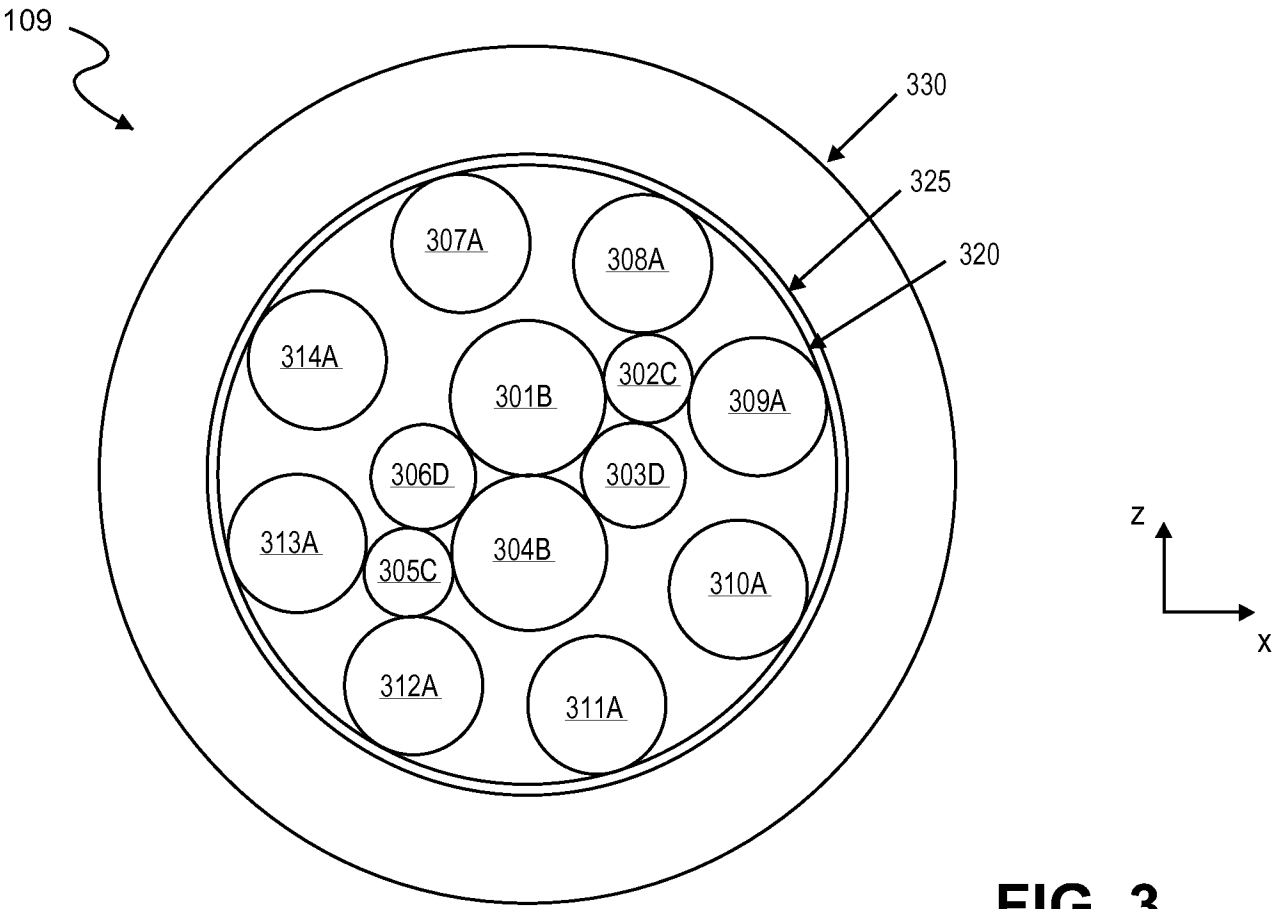
FIG. 3 is a cross-sectional view of a raw cable sub-assembly employed in the active electrical cable assembly of FIG. 1, in accordance with an embodiment.

FIG. 1 is an isometric illustration of an active electrical cable assembly 100, in accordance with an embodiment. The assembly 100 is shown in a state that is nearly completely assembled, with only a boot 106 (shown in dashed line) remaining to be press fit into final position. FIG. 2 is an isometric exploded view of the active electric cable assembly 100, in accordance with an embodiment. FIG. 3 is a cross-sectional view of a raw cable sub-assembly employed in the active electrical cable assembly of FIG. 1, in accordance with an embodiment. In FIGS. 1,2 and 3, like reference numbers are employed to identify like components.

Referring to FIG. 1, at a first end of the assembly 100 is a bottom metal shield 101 extending outward from a boot 106 (drawn in dashed line in FIG. 1) in a longitudinal direction (along the y-axis), which is operable for insertion into an I/O port of a computing platform. At a second end of the assembly 100 is a raw cable sub-assembly 108 that is to extend a given length (e.g., 0.5 meters, 3 meters, etc.) and terminate at a second end (not depicted), which in one embodiment includes an assembly substantially identical to the assembly 100, or alternatively, is any of: another single multi-contact connector, a plurality of connectors (each being multi-contact or single contact), or a terminal device (e.g., a device docking station, etc.).

The raw cable sub-assembly 108 passes through a strain relief tube 107 extending longitudinally outward from the boot 106. In embodiments, the strain relief tube 107 is not an overmold, but rather is an injection molded component that is mechanically fixed in place by other components of the assembly 100 so as to advantageously avoid the thermal stress typical of the overmold process. Generally, the strain relief tube 107 may be of any material having mechanical properties suitable for the application and further amenable to injection molding. In the exemplary embodiment, the strain relief tube 107 is silicone.

Enclosed within the boot 106 is a top shield 102 which mates with the bottom shield 101 to form a shield cavity. Generally, the bottom and top shields 101, 102 together shield electromagnetic/radio frequency (EM/RF) interference to/from the internal components of the assembly 100. The shields 101, 102 are conductive, and advantageously a sheet good (i.e., sheet metal) amenable to stamping. In embodiments, at least one of the shields 101, 102 include embossments (i.e., bosses) on opposite sides of the shield which mate with corresponding recesses or through holes disposed in the other of the shields 101, 102 and position the two separate shield portions with respect to each other during application of the boot 106. In the exemplary embodiment illustrated in FIGS. 1 and 2, through holes 181 are disposed in opposite sides of the top shield that receive the bottom shield embossments 191 and enable easy latching and assembly. With this latching capability, in combination with the one-piece boot 106, as further described elsewhere herein, a robust boot and shield assembly is achieved with low cost assembly and component manufacturing.

Affixed to at least one of the shields 101, 102, is a plug cap 105 that forms a collar around an electrically isolative exterior jacket 330 of the raw cable sub-assembly 108. In the exemplary embodiment, the plug cap 105 is crimped onto the raw cable sub-assembly 108 with the raw cable sub-assembly shield 325 folded back over the exterior jacket 330 to be disposed under the crimped plug cap 105. In the state shown in FIG. 1, the strain relief tube 107 is still separated from the adjacent plug cap 105 such that the outer jacket 330 of the raw cable sub-assembly 108 is visible between the plug cap 105 and the strain relief tube 107 allowing the illustration of the location of the cable sub-assembly shield 325, as held between the outer jacket 330 and the crimped plug cap 105. In embodiments, the plug cap 105 is metallic (e.g., stamped sheet metal) and is further electrically connected to at least one of the top and bottom shields 101, 102 (e.g., top shield 102) coupling the raw cable subassembly shield 325 with the shields 101, 102.

As further shown in FIG. 2, the plug cap 105 includes a plug cap tab 174 that extends into the shield cavity defined by the top and bottom shields 102, 101. In embodiments, the plug cap tab 174 is joined, for example by solder, to the top shield 102 through the though hole 182 (as illustrated in both FIGS. 1 and 2). The plug cap further caps an end the shield cavity opposite the exposed end of the bottom shield 101. In a fully assembled state, the strain relief tube 107 is disposed in close proximity, or direct contact, with the plug cap 105 when the boot 106 is longitudinally slid into final position as determined by features in shields 101, 102 described further elsewhere herein.

In embodiments, the raw cable sub-assembly 108 includes a plurality of high-speed signal wires. FIG. 3 is a cross-sectional view of the raw cable sub-assembly 108, in accordance with an embodiment. The raw cable sub-assembly 108 includes the isolative jacket 330, a shield 325, which in the exemplary embodiment is a braid, wrapping tape 320, and a plurality of wires over different type and gage disposed inside. The first wire type is a micro-coaxial signal wire, designated in FIG. 3 by reference numbers ending in "A" (307A, 308A, 309A, 310A, 311A, 312A, 313A, and 314A), and is employed for high speed signal transmission. The micro-coaxial wires may generally, be any commercially available, but in the exemplary embodiment are AWG 34 wires with a high temperature compatible insulation, such as PTFE (e.g., Teflon) for stability at soldering temperatures. A second wire type is employed for power, and designated in FIG. 3 by reference numbers ending in "B" (e.g., 301B, 304B). In the exemplary embodiment the power wire is AWG 24. A third wire type is employed for low speed signal transmission, and is designated in FIG. 3 by reference numbers ending in "C" (e.g., 302C, 305C). Low speed signal wires are each non-coaxial (i.e., each with only a single conductor and no dedicated shield) and employ AWG 34 in the exemplary embodiment. The fourth wire type is an AWG 28 wire for power ground, and is designated in FIG. 3 by reference numbers ending in "D" (e.g., 303D, 306D).

As shown in FIG. 3, the raw cable assembly includes 16 wires with a plurality of each wire type. The micro-coaxial signal wires 307A-314A are spatially distributed at the radial periphery of the cable, proximate the wrapping tape 320, and most distal from the power wires 301B, 304B. The power ground wires 302C, 305C, 303D, and 306D are disposed an intermediate radial distance from a longitudinal axis of the cable sub-assembly to be disposed between the power wires 301B, 304B and the high speed signal wires 307A-314A. Each of the micro-coaxial signal wires 307A-314A are to be coupled to contacts on the PCBA 103 (e.g., as further illustrated in FIGS. 4A and 4B), with four of the wires (e.g., 307A-310A) corresponding to the High-Speed Transmit 0 (positive) (HS0TX(P)), High-Speed Receive 0 (positive) (HSRX(P), High-Speed Transmit 0 (negative) (HSTX(N)), and High-Speed Receive 0 (negative) (HS0RX(N) contacts/pins, as defined by one or more ThunderBolt® standards. The other four wires similarly assigned to analogous pins for the 1 channel. Each of the low-speed signal wires 302C, 305C are also coupled to contacts on the PCBA 103 with one wire (e.g., 302C) corresponding to the ThunderBolt® LowSpeed Receive (LSP2R RX), and LowSpeed Transmit (LSR2P TX) contacts/pins.

Figure 4A:
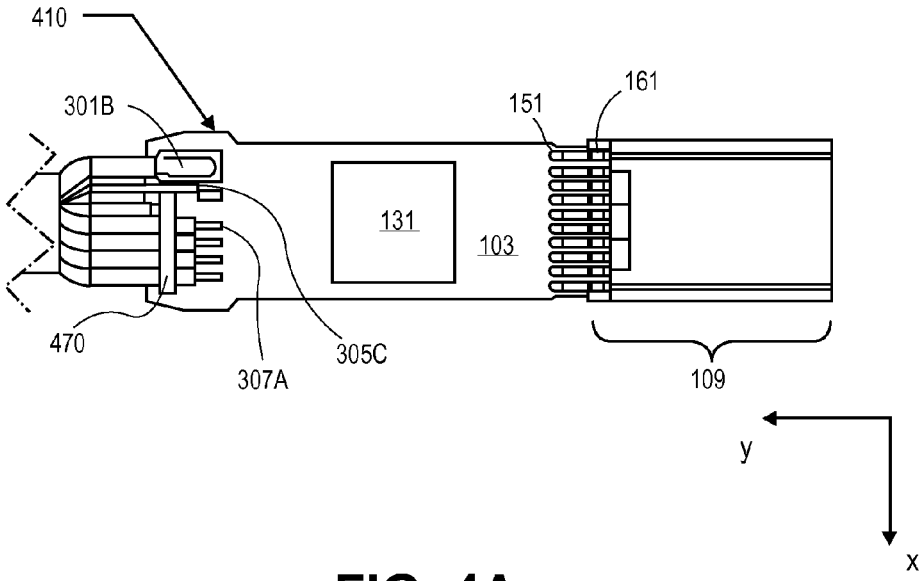
FIGS. 4A and 4B are plan views of a printed circuit board assembly (PCBA) employed in the active electrical cable assembly of FIG. 1, in accordance with embodiments.
Figure 4B:
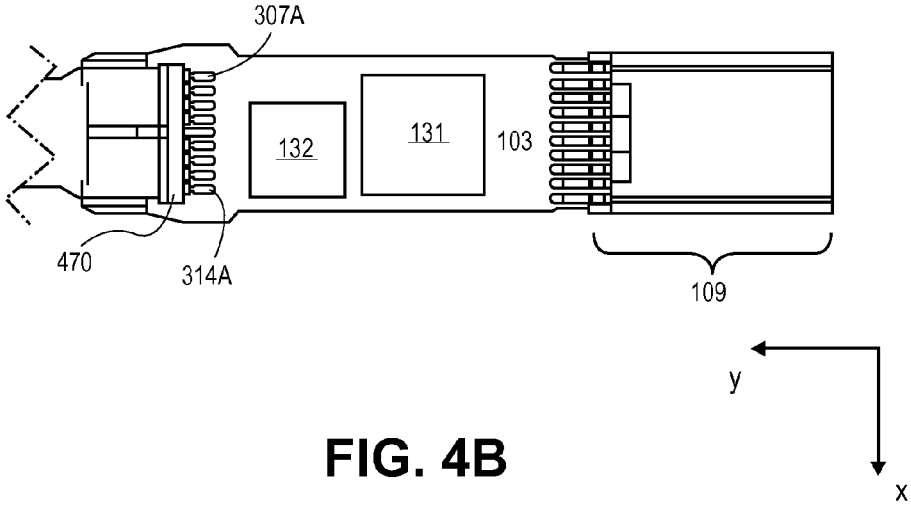

Referring back to FIG. 2, disposed within the shield cavity are at least a plug housing contact sub-assembly 109, and a printed circuit board assembly (PCBA) 103. FIGS. 4A and 4B are plan views of the printed circuit board assembly (PCBA) 103, in accordance with embodiments. Generally, the PCBA 103 hosts at least one IC chip 131 disposed on at least a first side 141. In embodiments, the IC chip 131 generally operates to actively improve the bandwidth of the cable assembly 100, and for the exemplary embodiment entails clock data recovery (CDR) circuitry. In further embodiments, a microcontroller unit (MCU) may also be disposed on the PCBA 103, either as a second IC chip 132 on the first PCBA side 141 (as illustrated in FIG. 4B), or as a second IC chip 132 disposed on a second PCBA side 142, opposite the first side 141. A plurality of CDR ICs may also be provided, for example with one CDR IC disposed on the first side 141 being responsible for a first communication channel and a second CDR IC disposed on the second side 142 being responsible for a second communication channel. A plurality of MCU ICs may also be similarly provided.

For the embodiment shown in FIG. 4A, a first subset of the micro-coaxial signal wires (e.g., 307A-310A) are terminated on a first side of the PCBA 103 while a second subset of the micro-coaxial signal wires (e.g., 311A-314A) are terminated on a second side of the PCBA 103. In the exemplary embodiment, each signal wire of the coaxial signal wires is soldered to an individual one of the contact pads 152 on the PCBA 103 while all the shields of the micro-coaxial signal wires (e.g., 307A) are electrically tied to a ground bar 470 that is soldered, or otherwise electrically coupled, to a ground contact on the PCBA 103. Similarly, a first of the low speed signal wires (e.g., 305C) is electrically and physically affixed (e.g., by solder) to one of the PCBA contact pads 152 on the first side (e.g., side 131), while the other of the low speed signal wires (e.g., 302C) is connected to an opposite side of the PCBA 103. The power wire 301B is further connected to the first PCBA side 141 (e.g., by solder) while the second power wire 304B is connected to the second PCBA side 142 (e.g., by solder).

For the embodiment shown in FIG. 4B, all the micro-coaxial (high speed) signal wires (e.g., 307A-314A) are terminated on a same side of the PCBA 103 (e.g., by a solder connection). All eight micro-coaxial signal wires have their respective shields electrically connected to the ground bar 470, while the individual center conductors (e.g., 34 AWG) are soldered, or otherwise electrically connected, to respective ones of the metal PCBA contacts 152. In this embodiment, the low speed signal wires (e.g., 302C, 305C), power wires (e.g., 301B, 304B), and ground wires (303D, 306D) are all terminated on an opposite side of the PCBA 103.

As shown in FIGS. 2, 4A, and 4B, the PCBA 103 has metal contact pads 151 disposed at an end opposite of the raw cable assembly metal contact pads 152 to electrically connect with conductors of the plug housing contact sub-assembly 109. The plug housing contact sub-assembly 109 may be of any conventional design supporting the pin counts and assignments designated in relevant design specifications for the ThunderBolt® product line (e.g., 20 pins). In the exemplary embodiments, the plug housing contact sub-assembly 109 comprises two rows of 10 tensioned metal conductors 161, 162 seated in a plastic, such as, but not limited to liquid crystal polymer (LCP). The two rows of conductors 161, 162 are spaced to receive an edge of the PCBA 103, sliding over the edge so that the PCBA 103 inserts between the two rows of tensioned metal conductors 161. The plug housing contact sub-assembly 109 is dimensioned to align to edges of the PCBA 103 such that individual ones of the metal conductors 161, 162 make contact with individual ones of the metal contact pads 151. As shown in FIGS. 1 and 2, the plug housing contact sub-assembly 109 is disposed within the shield cavity formed by the bottom and top shields 101, 102 to present the conductors 182 to contacts of an I/O port. Referring again to FIG. 4A, the PCBA 103 further includes stops 410 formed in the circuit board at an end opposite the stops 409 (i.e., proximate to the signal wire 307A) to contact a sidewall 411 of the bottom shield 101, as shown in FIG. 2, and thereby resist passage of the plug housing contact sub-assembly 109 longitudinally through the end of the bottom shield 101 opposite the raw cable sub-assembly 108.

In embodiments, the electical cable assembly includes electrical insulation disposed between the PCBA 103 and the bottom and top metal shields 101, 102. This electrical insulation is to electrically isolate one or more of: the wire terminations on the PCBA 103; the ICs on the PCBA 103; the plug housing contact sub-assembly conductors 161; and the contact pads 151, 152. In embodiments, the electrical insulation disposed between the PCBA 103 and the bottom and/or top metal shields 101, 102 includes at least one electrically isolative film disposed within the shield cavity. FIG. 2 illustrates one exemplary embodiment where the isolative film is in the form of two individual sheets 112A and 112B that are disposed along opposide interior sidewalls of the top and/or bottom shields 102, 101. While the isolative film sheets 112A, 112B may be of any dielectric conventional for such an application, in the exemplary embodiment the dieelctric film is composed of a polyester, such as but not limited to Mylar™, which has a suitably high dielectric constant.

With the film sheets 112A, 112B providing electrical insulation from the sidewalls of the shield cavity, further electrical isolation from top and bottom interior surfaces of the metal shields 101, 102 is provided by electrially isolative thermal pads 110 and 111 (depicted in FIG. 2). As shown in FIG. 2, the thermal pad 111 is disposed on the IC 131 and with the shield cavity properly dimensioned, the thermal pad 111 is in physical contact with the top shield 102 to conduct heat from the IC 131 to the top shield 102. Similarly the thermal pad 110 is in physical contact with the bottom shield 101 to conduct heat from the opposite side of the PCBA 103 (e.g., from a second IC, etc.). In the exemplary embodiment, the thermal pad 110 has a y-axis length substantially equal to that of the PCBA 103 (i.e., substantially larger than dimensions of an IC disposed on the PCBA 103). As such, the isolative film sheets 112A and 112B are adjacent to opposite sides of the PCBA 103 and the thermal pads 110, 111 to completely isolate the PCBA 103 from the metal shields 101, 102. The thermal pads 110 and 111 may be of any material composition conventional for the application, however in the exemplary embodiment, the thermal pads 110, 111 are silicon-based with a filler, such as silicone, and a binder, such as alumina. The thermal pads 110 and 111 advantageously have a high thermal conductivity, such as greater than 5 W/m*K and more advantageously at least 7 W/m*k. The thermal pads 110 and 111 also advantageoulsy have a high electrical resistance, such as at least $10^{11}$ ohm-m, and a dielectric constant of at least 5. One commerical source for such material is Intermark, USA of San Jose, Calif.

Completing the internal electrical isolation from the metal shields 101, 102 is a wire holder 104. The wire holder 104 further functions as a support of the length of wires extending from the jacket 330, improving the assembly's resistance to shock and vibration. The wire holder 104 may be of any electrically isolative material conventional for such applications, such as, but not limited to plastics. In certain embodiments, a high temperature plastic (e.g., a liquid-crystal polymer) is employed for stability during wire solder.

Figure 5:
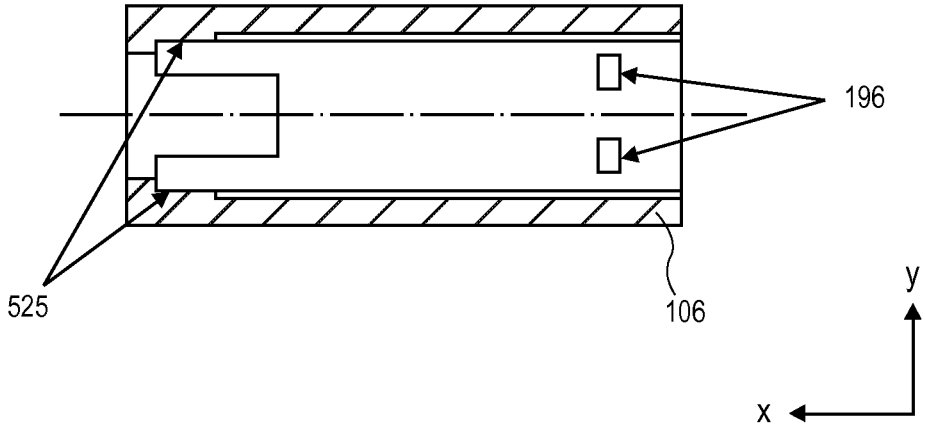
FIG. 5 is a cross-sectional view of a single-piece boot employed in the active electrical cable assembly of FIG. 1, in accordance with an embodiment.

FIG. 5 is a cross-sectional view of the single-piece boot 106 employed in the active electrical cable assembly of FIG. 1, in accordance with an embodiment. The one-piece boot is of an electrically insulating material and advantageously of a material that can be injection molded, such as, but not limited to, polycarbonate. Exemplary dimensions of the boot 106 are 27.6 mm in the y-dimension, 10.8 mm in the x-dimension and 7.9 mm in the z-dimension. Being one piece, no gluing or welding of the boot 106 is required to manufacture the assembly 100. As shown in FIG. 5, the boot 106 includes internal stops 525 that, when installed over the metal shields 101, 102, are adjacent to the top shield 102 to resist displacement of the top shield 102 in a longitudinal direction toward the raw cable sub-assembly 108, for example when the exposed portion of the bottom shield 101 is inserted into a receiving port. Because the top shield 102 is latched into the bottom shield 101, the stops 525 resist displacement of the bottom shield 101 further into the boot 106. In embodiments, the boot 106 further includes an internal recess or embossment to mate with a complementary feature in at least one of the top and bottom shields. As further shown in FIG. 5, in the exemplary embodiment the boot 106 further includes an internal recess 196 to latch onto the bottom shield 101, thereby resisting extraction of the shields 101, 102 from the boot 106. As further illustrated in FIG. 2, the recess 196 formed in the boot 106 receives the embossment 195.

Figure 6:
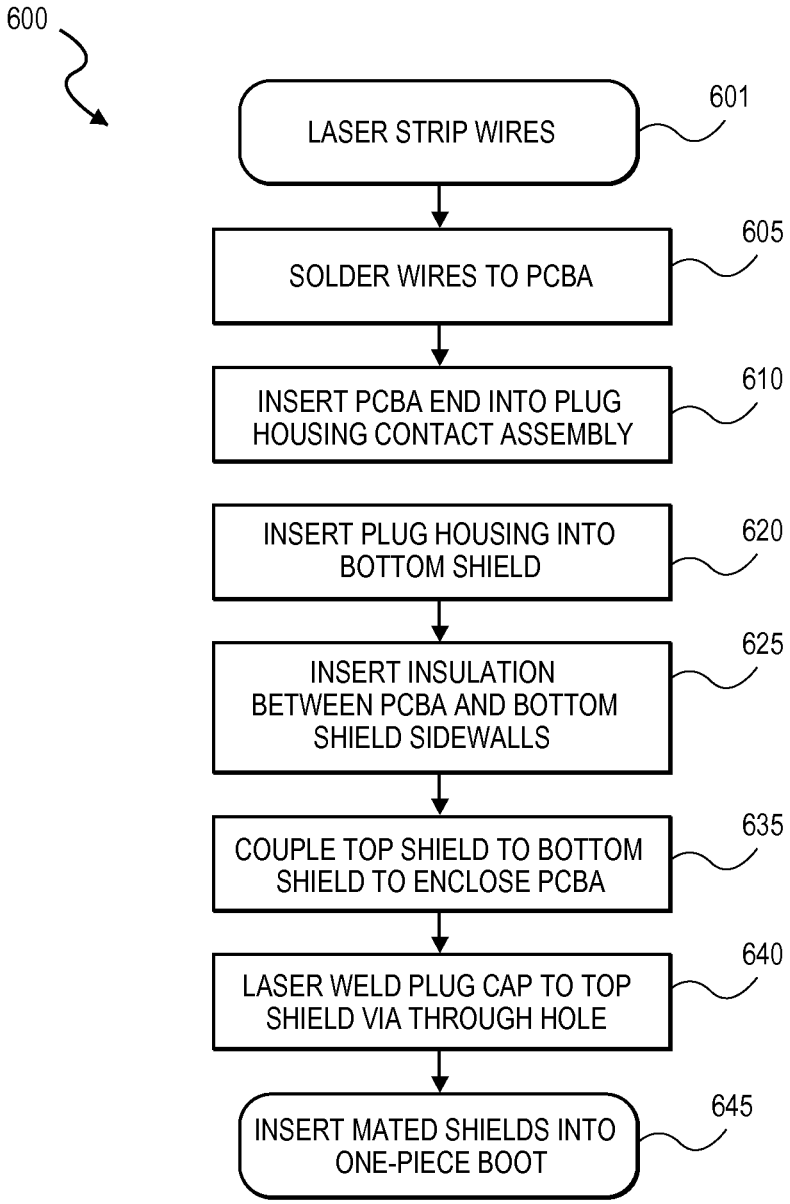
FIG. 6 is a flow diagram illustrating a method of forming the cable assembly of FIG. 1, in accordance with an embodiment.

With functional, structural, and compositional elements of the cable assembly 100 described, FIG. 6 is a flow diagram illustrating a method 600 for forming the cable assembly 100, in accordance with an embodiment. Generally, the operations in method 600 may be performed following a number of different ordering sequences. Hence, no order is implied by the relative positions of the operations identified in method 600. Furthermore, the operations noted in method 600 are not presented as an exclusive listing of every operation in the manufacture of the cable assembly 100.

The method 600 begins with laser stripping ends of the plurality of wires in the raw cable sub-assembly at operation 601. Laser stripping is advantageous over other stripping techniques for better control of line impedance, to which the high speed wires (e.g., micro-coaxial wire 307A) are particularly sensitive. The exposed wire ends are then soldered to the PCBA 103 at operation 605. In advantageous embodiments, soldering is by laser to again tightly control parameters of the electrical connection made between the PCBA 103 and the wires. At operation 610 the PCBA 103 is inserted into the plug housing contact sub-assembly 109 to couple pins of the plug housing contact sub-assembly with metal pads disposed on the second end of the PCBA. The PCBA 103 and plug housing contact sub-assembly 109 are then inserted into the bottom shield 101. PCBA stops 410 may at this time make contact with the sides 411 of the bottom metal shield 101. With the thermal pad previously affixed to ICs on the PCBA 103, the isolative film sheets 112A, 112B are inserted between the PCBA 103 and the sidewalls of the bottom shield 101 at operation 625. The wire holder 104 may similarly be inserted at this time.

At operation 635, the top shield 102 is coupled to the bottom shield 101, for example by latching the embossments 191 into the corresponding receiving through holes 181, to enclose the PCBA 103 within the shield cavity. The plug cap 105 is then slid over the length of raw cable sub-assembly 108, fitted into the end of the shield cavity proximate to the wire holder 104 to have the tab 174 disposed in alignment with the through hole 182 and crimped in place over the shield 325. At operation 640, the tab 174 is then laser welded to the top shield 102 as accessed by the through hole 182. The relief tube 107 is slid over the length of raw cable sub-assembly 108 to be adjacent to the plug cap 105. The method 600 completes at operation 645 with sliding the boot 106 over the length of the raw cable sub-assembly 108, over the relief tube 107 and over the latched bottom and top metal shields 101, 102 until latching into place.

Figure 7:
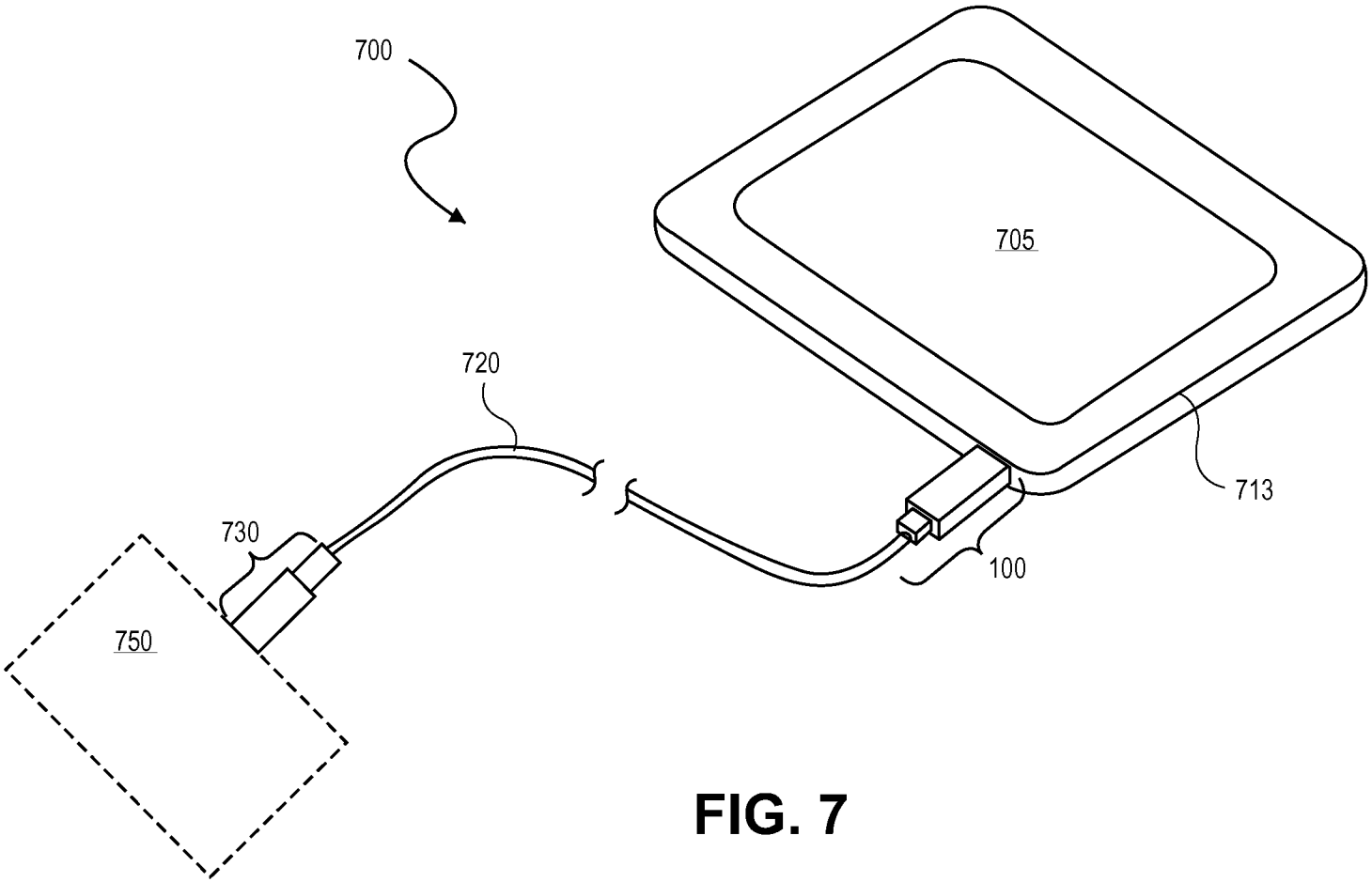
FIG. 7 is a functional block diagram of a computing platform employing the cable assembly illustrated in FIG. 1 to communicatively couple to a peripheral device, in accordance with an embodiment of the present invention.

FIG. 7 is a functional block diagram of a system 700 including computing platform 713 commuicatively coupled to a peripheral device 750 by the cable assembly 100, in accordance with an embodiment of the present invention. As shown, the cable assembly 100 is attached to a length 720 of the raw cable sub-assembly 108, which is further coupled to a connector 730 that interfaces to the peripheral device 750. The connector 730 may for example, be a second implementation of the assembly 100 or an alternative implementation of a single multi-contact connector (e.g., a male multi-pin connector) electrically connected to each of the plurality of wires described elsewhere herein in the context of the cable assembly 100. The peripheral device 750 is in one embodiment a solid state drive (SSD) having memory to store data transmitted over the cable assembly 100, and in another embodiment is a docking station suitable for coupling to one or more mobile devices, such as, but not limited to a smart phone, tablet, or laptop computer. In alternative embodiments, the peripheral device 750 is a WAN or LAN port such that the assembly 100 transmits data to/form the computing platform 713 to the WAN or LAN.

Generally, the computing platform 713 may be any device configured for each of electronic data display, electronic data processing, and may further include a wireless electronic data transmission capability as a mobile device. For example, computing platform 713 may be any of a tablet, a smart phone, laptop computer, desktop computer, server appliance, etc. The exemplary computing platform depicted includes a display screen 705, a microprocessor, non-volatile memory in the form of flash memory or STTM, etc., and a battery. The platform 713 generally further includes a circuit board hosting a number of components, such as but not limited to a processor (e.g., an applications processor) and at least one communication chip, where the term "processor" may refer to any device or portion of a device that processes electronic data from registers and/or memory to transform that electronic data into other electronic data that may be stored in registers and/or memory.

In some embodiments, the computing platform 713 includes other components, such as, but are not limited to, volatile memory (e.g., DRAM), a graphics processor, a digital signal processor, a crypto processor, a chipset, an antenna, touchscreen display, touchscreen controller, battery, audio codec, video codec, power amplifier, global positioning system (GPS) device, compass, accelerometer, gyroscope, speaker, camera, and mass storage device (such as hard disk drive, solid state drive (SSD), compact disk (CD), digital versatile disk (DVD), and so forth).

In embodiments, a peripheral extension bus in the platform enables communications for the transfer of data to and from the platform 713 through the cable assembly 100 at a data rate of at least 10 Gbit/sec. The extension bus may implement any of a number of communication standards or protocols, including but not limited those associated with products marketed under the Thunderbolt® trade name. In one embodiment, the cable assembly 100 is inserted into a Thunderbolt® port of the computing platform 713, the port accommodating Thunderbolt® pin assignments (e.g., 20 pins), data rates (e.g., 10 Gbit/s per device), etc.

In further embodiments, the computing platform 713 and/or peripheral device 750 includes a wireless communication chip that may be capable of shorter range wireless communications such as Wi-Fi and Bluetooth and/or capable of longer range wireless communications such as GPS, EDGE, GPRS, CDMA, WiMAX, LTE, Ev-DO, and others.

It is to be understood that the above description is intended to be illustrative, and not restrictive. For example, while flow diagrams in the figures show a particular order of operations performed by certain embodiments of the invention, it should be understood that such order is not required (e.g., alternative embodiments may perform the operations in a different order, combine certain operations, overlap certain operations, etc.). Furthermore, many other embodiments will be apparent to those of skill in the art upon reading and understanding the above description. Although the present invention has been described with reference to specific exemplary embodiments, it will be recognized that the invention is not limited to the embodiments described, but can be practiced with modification and alteration within the spirit and scope of the appended claims. The scope of the invention should, therefore, be determined with reference to the appended claims, along with the full scope of equivalents to which such claims are entitled.

What is claimed is:

1. A cable assembly comprising:

a top metal shield and a bottom metal shield, wherein one of the top and bottom metal shields comprises an embossment and the other of the top and bottom metal shields comprises a recess or through hole to mate with the embossment and form a shield cavity;

a printed circuit board assembly (PCBA), including at least one integrated circuit (IC), disposed within the shield cavity;

at least one electrically isolative film sheet disposed within the shield cavity and between the PCBA and the top or bottom metal shield;

a raw cable sub-assembly further comprising:

a plurality of wires terminated at the PCBA, the plurality including at least a micro-coaxial signal wire, a power wire, and a ground wire; and an electrically isolative jacket surrounding the plurality of wires; and a single piece boot surrounding the raw cable sub-assembly, the top shield and the bottom shield.

2. The cable assembly of claim 1, wherein the boot further comprises an internal recess to mate with at least one of the top and bottom shields, and wherein the boot further comprises internal stops adjacent to at least one of the top and bottom shields to resist displacement of the shields in a longitudinal direction toward the raw cable sub-assembly.

3. The cable assembly of claim 1, wherein the assembly further comprises a first electrically isolative thermal pad disposed between an interior surface of the shield cavity and the PCBA; and wherein the at least one film sheet further comprises first and second film sheets adjacent to opposite sides of the PCBA and the first thermal pad.

4. The cable assembly of claim 3, wherein the assembly further comprises a second electrically isolative thermal pad disposed between the PCBA and the shield cavity on a side of the PCBA opposite the first thermal pad.

5. The cable assembly of claim 1, wherein the PCBA further comprises first contact pads disposed on a first end to which the wires are soldered and second contact pads disposed on a second end, opposite the first end, to which conductors of a plug housing contact sub-assembly make contact, the plug housing contact sub-assembly disposed within the bottom shield.

6. The cable assembly of claim 5, wherein the PCBA further comprises stops to contact a sidewall of the bottom shield and resist passage of the plug housing contact sub-assembly through an end of the bottom shield opposite the raw cable assembly.

7. A system comprising:

the cable assembly of claim 1; and a single multi-contact connector coupled to a second end of the cable assembly, the single multi-contact connector connected to each of the plurality of wires.

8. The system of claim 7, wherein the single multi-contact connector is a male connector.

9. A system comprising:

a peripheral device coupled to a second end of the cable assembly of claim 1, the peripheral device including a memory to store data transmitted over the cable assembly.

10. The system of claim 9, wherein the peripheral device comprises a solid state drive (SSD).

11. The cable assembly of claim 1, further comprising a plug cap crimped to an end of the raw cable sub-assembly proximate the PCBA and soldered to the top metal shield.

12. The cable assembly of claim 11, wherein the pug cap is soldered to the top metal shield at a location coincident with a through hole disposed in the top metal shield.

13. The cable assembly of claim 11, further comprising a strain relief tube disposed over the raw cable sub-assembly and adjacent to an end of the plug cap opposite the PCBA, the strain relief tube partially disposed within the boot and extending outwardly beyond the boot.

14. The cable assembly of claim 1, wherein the plurality of wires further comprises at least one non-coaxial signal wire.

15. The cable assembly of claim 14, wherein the plurality of wires further comprises:

a plurality of the micro-coaxial signal wires;

a plurality of the non-coaxial signal wires;

a plurality of the power wires; and a plurality of the ground wires.

16. The cable assembly of claim 15, wherein the power and ground wires are proximate a longitudinal center of the raw cable sub-assembly, and the plurality of micro-coaxial signal wires are proximate the jacket and distal from the power and ground wires.

17. The cable assembly of claim 15, wherein a first of the micro-coaxial signal wires is terminated on a first side of the PCBA and wherein a second of the micro-coaxial signal wires is terminated on a second side of the PCBA.

18. A method of assembling an cable assembly, the method comprising:

soldering a plurality of wires extending from a raw cable sub-assembly to metal pads disposed on a first end of a printed circuit board assembly (PCBA);

inserting a second end of the PCBA, opposite the first end, into a plug housing contact sub-assembly to couple pins of the plug housing contact sub-assembly with metal pads disposed on the second end of the PCBA;

inserting the PCBA into a bottom metal shield to contact stops on the PCBA with sides of the bottom metal shield;

disposing at least one electrically isolative film sheet between the PCBA and sides of the bottom metal shield;

mating an embossment in one of the bottom shield and a top metal shield with a recess or through hole in the other of the bottom and top metal shields to surround the PCBA within a shield cavity; and inserting the mated top and bottom metal shields into a single-piece boot until a recess in at least one of the boot or shields latches with an embossment in the other of the boot or shields.

19. The method of claim 18, further comprising laser stripping a plurality of wires extending from a raw cable sub-assembly to expose wire ends for soldering to the PCBA.

20. The method of claim 18, further comprising:

crimping a plug cap over the raw cable sub-assembly to contact a shield of the raw cable sub-assembly; and laser welding the plug cap to one of the top and bottom shields, the plug cap accessed by a through hole in at least one of the top and bottom shields.

* * * * *